US005485913A

United States Patent [19]

Steinfels, III

[11] Patent Number: 5,485,913

[45] **Date of Patent: *Jan. 23, 1996**

[54] PRODUCT ACCESSIBLE DISPLAY CONTAINER

[76] Inventor: Victor E. Steinfels, III, 8627 Gavinton Ct., Dublin, Ohio 43017

[ * ] Notice: The term of this patent shall not extend beyond the expiration date of Pat. No. 5,348,145.

[21] Appl. No.: 285,810

[22] Filed: Aug. 4, 1994

Related U.S. Application Data

[63] Continuation of Ser. No. 125,648, Sep. 22, 1993, Pat. No. 5,348,145.

[51] Int. Cl.[6] ..... B65D 85/44

[52] U.S. Cl. ..... 206/45.19; D7/515; 206/45.14; 206/446

[58] Field of Search ..... D7/515; 206/45.14, 206/45.15, 45.19, 45.34, 303, 426, 521, 588, 591, 446

[56] References Cited

U.S. PATENT DOCUMENTS

| | | | |
|---|---|---|---|
| 3,481,453 | 12/1969 | Shreve, III et al. | 206/45.31 |
| 3,765,529 | 10/1973 | Mueller | 206/45.14 |
| 3,896,927 | 7/1975 | Dutcher | 206/45.14 |
| 3,896,928 | 7/1975 | Forte | 206/45.14 |
| 4,099,612 | 7/1978 | Hanson | 206/45.19 |
| 4,285,432 | 8/1981 | de Villers et al. | 206/591 |
| 4,385,687 | 5/1983 | Dutcher | 206/45.19 |
| 4,397,393 | 8/1983 | Pergande et al. | 206/45.31 |
| 4,779,726 | 10/1988 | Pratt | 206/303 |
| 5,156,276 | 10/1992 | Lebowitz | 206/588 |

FOREIGN PATENT DOCUMENTS

| | | | |
|---|---|---|---|
| 1174044 | 12/1969 | United Kingdom | 206/45.19 |

*Primary Examiner*—Jimmy G. Foster
*Attorney, Agent, or Firm*—Mueller and Smith

[57] ABSTRACT

A packaging container is disclosed which is adapted for accessibly displaying an article packaged therewithin. The container is provided as having a floating deck portion with an opening therethrough for receiving the base of an annular article, and a retainer assembly extending from the lid of the container downwardly into the article. The retainer assembly and floating deck portion cooperate to retain the article laterally within the container while allowing for the direct visual and tactual inspection of the article by a potential purchaser.

26 Claims, 4 Drawing Sheets

PRODUCT ACCESSIBLE DISPLAY CONTAINER

CROSS-REFERENCE TO RELATED APPLICATION

This application is a continuation of application U.S. Ser. No. 08/125,648 filled Sep. 22, 1993, now U.S. Pat. No. 5,348,145.

BACKGROUND OF THE INVENTION

Consumers often have a desire to inspect a product both visually and tactually before making a purchase. This is especially true when such purchase involves an unfamiliar product. Package designers heretofore have had difficulty in accommodating this desire while maintaining the integrity of product packaging and maximizing the available graphic surface area thereon. Indeed, it is common at the point of sale for a customer to attempt to open a package and remove the product therefrom. Such attempts generally resulting in damage to the package, the product, or both. Even if the product remains undamaged, it is nevertheless often unsalable as customer perception generally equates a damaged package to a damaged product. The integrity of the packaging of the product is particularly important when the contemplated purchase is destined to become a gift as consumers rarely, if ever, will purchase a gift having damaged packaging.

Moreover, damaged packages mar the overall point of sale display by suggesting a product of inferior quality and, consequently, may dissuade the customer from making a purchase. Damaged packaging therefore represents a significant expense to the retailer who must waste valuable retail space on non-salable products and must ultimately return the damaged packages and products to the manufacturer or attempt to sell the goods at a discount. If returned, the damage goods also represent a significant expense to the manufacturer who must repackage the product and then resell and reship the goods to a retailer. Thus, damaged packaging results in a considerable expense to both the retailer and the manufacturer despite the fact that the product itself may remain undamaged.

Accordingly, designers of product packaging have attempted to address the problem of package damage by packaging products in a manner giving maximum visibility to the product inside the package. One such example is the ubiquitous blister pack which may be found in any retail outlet. While providing maximum product visibility, blister packs generally prevent the purchaser from tactually examining the product. Such packaging also minimizes the surface area available for descriptive text or graphics related to the marketing or use of the product.

As an alternative to the blister packs, package designers have sought a compromise in packaging products in boxes or other containers having a shrink-wrap covering. Although offering increased surface area for graphics and the like and providing for visual inspection of the product, a shrink wrap packaging arrangement nonetheless inhibits full tactile inspection of the product. It is also susceptible to customer breakage resulting in a non-salable product.

Further, neither blister nor shrink-wrap packaging generally is perceived as acceptable for displays in higher end retail stores. In such markets it is of utmost importance that customers be permitted to freely handle and inspect potential purchases in order to instill into the customer a high degree of purchasing confidence. The customer thereby is put at ease and may be more likely to make a purchase. Blister packs and shrink-wrapped packages, however, suggest that the product needs protection from the customer. The customer therefore may perceive that he or she is not trusted to properly handle the products, and may forego making a purchase.

In view of the foregoing, it is apparent that there has existed and remains a need for an improved product package which facilitates both the visual and the tactile examination of the goods. Indeed, for those products where the salable aspect of the product is proven in the tactile experience, it is imperative that the customer be afforded the opportunity to both visually and tactually inspect the product. The packaging schemes heretofore known in the art, however, have not been successful in so affording. Accordingly, the provision of a packaging scheme which permits a purchaser to inspect all aspects of a product both visually and tactually would be well-received by the manufacturing and retail industries, as well as by the consuming public in general.

SUMMARY OF THE INVENTION

The present invention is addressed to a packaging container which is adapted for accessibly displaying an article packaged therewithin. In being provided with a floating deck portion having an opening for receiving the base of an annular article, and a retainer assembly extending from the lid of the container downwardly into the article, the present invention advantageously facilitates the visual and tactile inspection of the article without damage to the packaging or the removal of the product from the packaging. Additionally, the walls of the container, in connection with a spacer assembly which elevates the article off the surface of the container bottom, provides maximum product exposure and needed surface area for the printing of promotional or informational graphics or text. For cylindrical articles, the floating deck portion opening may be circularly configured to permit the rotation of the article therewithin about the retaining assembly. In addition, for articles having handles, the circular opening may be eccentrically located in the floating deck portion to space the handle of the article a predetermined distance from a side wall. This spacing enables the rotation of the article from a shipping position wherein the handle is disposed orthogonally to the side wall minimizing the volume occupied by the product and packaging, to a display position wherein the handle is disposed parallel to the side wall to be accessible by a potential purchaser.

Advantages of the present invention include the provision of a recyclable display container which may be produced relatively inexpensively, is easy to ship in bulk, and is capable of attractively displaying and protecting from damage an article contained therein without itself being damage during shipping or at the point of sale display. The invention may be folded from a single sheet of recycled paperboard rather than from multiple sheets which would each require handling, folding, and disposal. Additionally, the assembly and packing of the container of the present invention may take place in different stages or in different locations as the blank thereof may be preglued into a collapsibly flat configuration. Such configuration facilitates the handling and shipment of the blank to another location such as the manufacturing site of the product to be packaged. Moreover, the generally cubic shape and structural integrity of the inventive container facilitates its packing in a close-packed arrangement within a shipping container and also its aesthetically pleasing stacking and arranging at the point of sale. The container of the invention also protects the packaged article from damage as the article is prevented from contacting the sides of the container or other packaged articles.

Additional advantages of the invention include a design that allows a potential purchaser to inspect the packaged product, and that provides detailed information regarding the use of the product. The container of the invention also provides the purchaser with the ability to view all sides of the packaged article via its rotation within the container. From a frontal or side elevational view, the purchaser may undertake an unobstructed visual inspection of the packaged product which is neatly framed within the container. Once the product is purchased and is removed from the container by the purchaser, the container may be disposed of in an environmentally safe manner.

In short, the product accessible display container of the present invention provides for all of the above described advantages in a relatively inexpensive and simple design. The invention, accordingly, comprises the combination of elements and arrangement of parts which are exemplified in the following detailed description. Reference to that description and to the accompanying drawings should be had for a fuller understanding and appreciation of the nature and objects of the invention, although other objects will be obvious to those skilled in the art.

DETAILED DESCRIPTION OF THE INVENTION

In the discourse to follow, the present invention for packaging an annular article for its visual and tactual display is illustrated in connection with the packaging of the insulated beverage sleeve shown in U.S. Pat. No. Des. 337,242, such sleeve now being marketed under the name TEAMMUG™ by the Vesmont Management Group, Inc., of Dublin, Ohio. Specifically, the TEAMMUG™ insulated beverage sleeve is a drinking mug/can holder configured to resemble an authentically-detailed football helmet having a facemask which may be utilized as an handle. Inasmuch as in the game of football the grabbing of a facemask constitutes an infraction, an attractive feature of the TEAMMUG™sleeve is the novelty that the facemask thereof may be grabbed by a potential purchaser without a penalty resulting. In this regard, the container of the present invention may be seen as especially adapted for the visually and tactilely accessible packaging and display of annular articles, such as the TEAMMUG™ sleeve, having graspable handles. However, it will be appreciated that the inventive container also will find advantageous utility in the packaging of other annular articles and the like.

Figure 1:
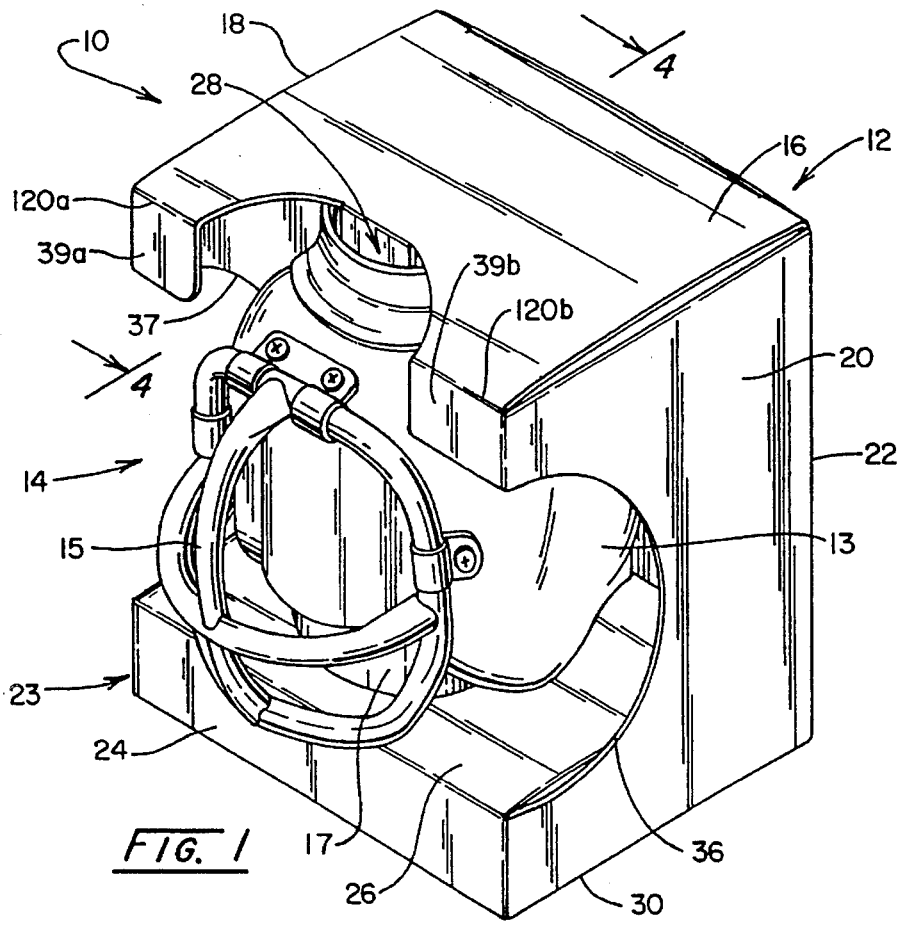
FIG. 1 is a perspective view showing a container in accordance with the present invention having a TEAMMUG™ insulated beverage sleeve packaged therewithin for its tactilely accessible display.

Referring now to the figures, wherein like reference numerals designate like parts, and looking to FIG. 1 in particular, an article packaged in accordance with the precepts of the present invention is depicted generally at 10 to be comprised of a container, shown generally at 12, and an article, shown generally at 14, as having a graspable handle, 15, extending from the annular wall 13, of the base, 17, thereof. Container 12 is provided as having a top wall or lid, 16, an oppositely-disposed bottom wall or bottom, 30, a pair of oppositely-disposed sidewalls, 18 and 20, extending between lid 16 and bottom 30, and a rear wall 22, extending between lid 16 and bottom 30 adjacent side walls 18 and 20. Collectively, 16, 18, 20, 22, and 30 form a generally cubic structure within which article 14 is packaged for shipment and display.

For retaining base 17 of article 14 laterally within container 12, a base assembly, shown generally at 23, is provided as having a floating deck portion, 26, disposed generally parallel to bottom 30, and a front wall portion, 24, extending generally orthogonally from floating deck portion 26 to bottom 30 to locate floating deck portion 26 a predetermined vertical distance therefrom. Looking momentarily to FIG. 5, wherein the plan view of a paperboard blank adapted for foldable assembly into container 12 is shown generally at 27, floating deck portion 26 is shown as having an opening, represented at 25, which is circularly configured to receive the base 17 of annular article 14.

Returning to FIG. 1, it may be seen that, importantly, floating deck portion 26 is provided to be inwardly folded about front wall portion 24 to be generally upwardly biased towards lid 16. By virtue of such biasing, opening 25 of floating deck portion 26 is made to elliptically intersect annular wall 17 of article 14, and floating deck portion 26 is made to be freely moveable in the direction of a vertical translation of article 14. Accordingly, base 17 of article 14 is laterally retained within container 14 even as article 14 is lifted vertically towards lid 16.

Figure 2:
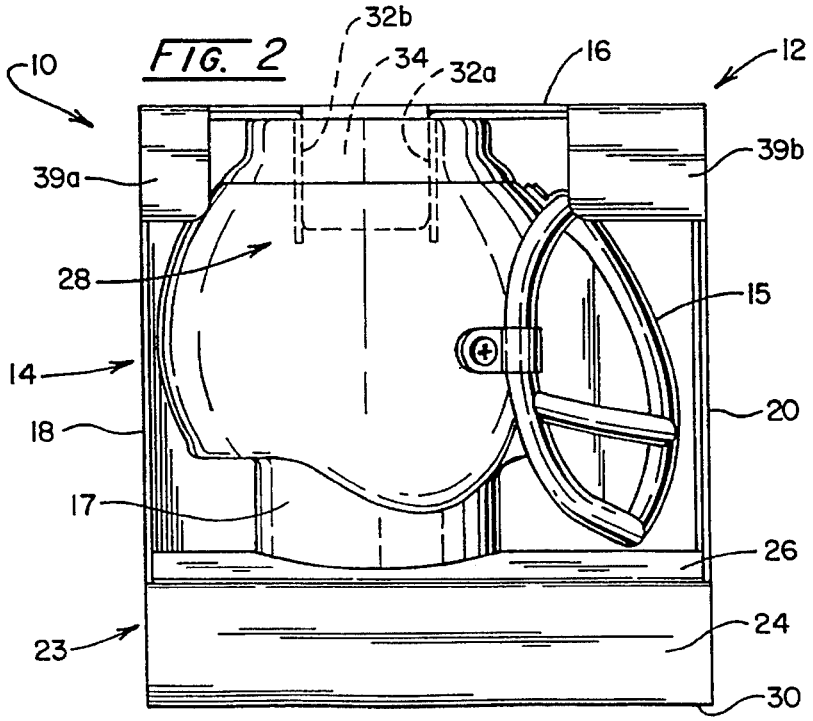
FIG. 2 is a front elevational view of the container and packaged beverage sleeve of FIG. 1 showing the sleeve disposed in its shipping position for storage or shipment.

For retaining the top of article 14 laterally within container 12, lid 16 is provided with a retainer assembly, shown generally at 28, which extends downwardly from lid 16 and into the annular extent of article 14. Referring additionally to FIG. 2, wherein retainer assembly 28 is shown phantom, it may be seen that retainer assembly 28 preferably is provided to include a pair of oppositely-disposed, side retaining tabs, **32*a* and 32*b*, folded downwardly from lid 16 generally orthogonal to rear wall 22, and a front retaining tab, 34, folded downwardly from lid 16 generally orthogonal to side tabs 32**.

Figure 3:
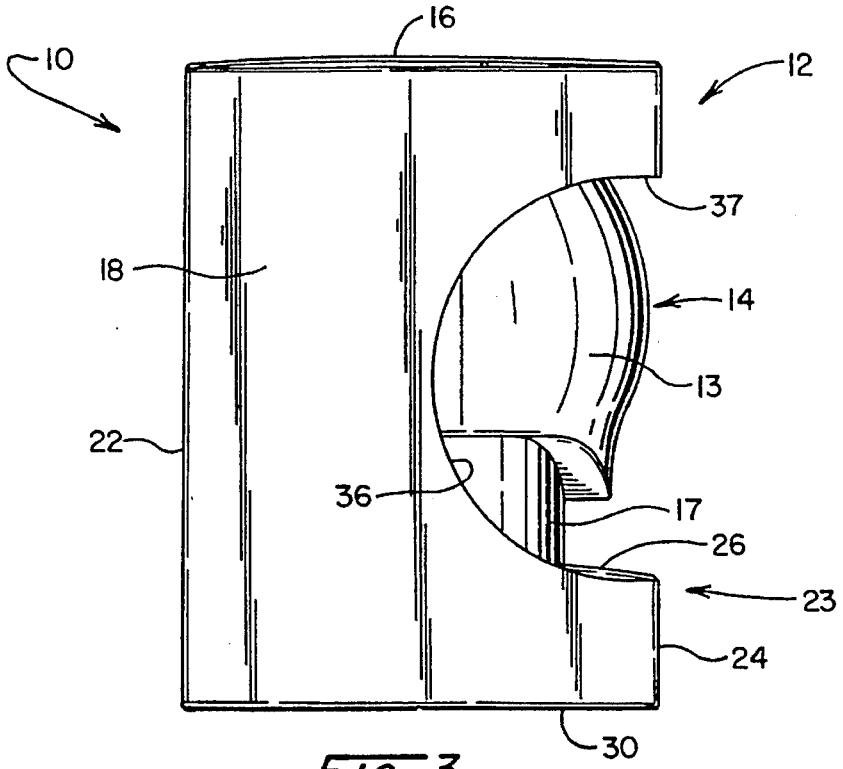
FIG. 3 is a left side elevational view of the container and packaged beverage sleeve of FIG. 2.
Figure 4:
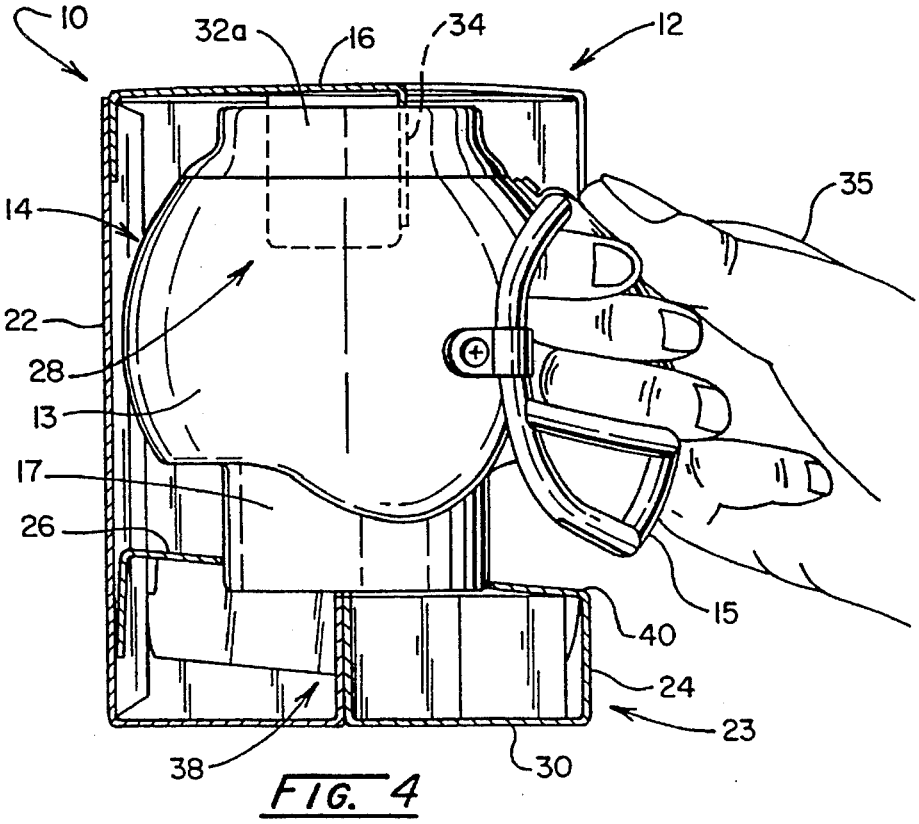
FIG. 4 is a cross-sectional view taken along reference line 4—4 of FIG. 1 of the container and packaged beverage sleeve of FIG. 1 showing the sleeve disposed in its display position and a customer tactually accessing the handle thereof.
Figure 5:
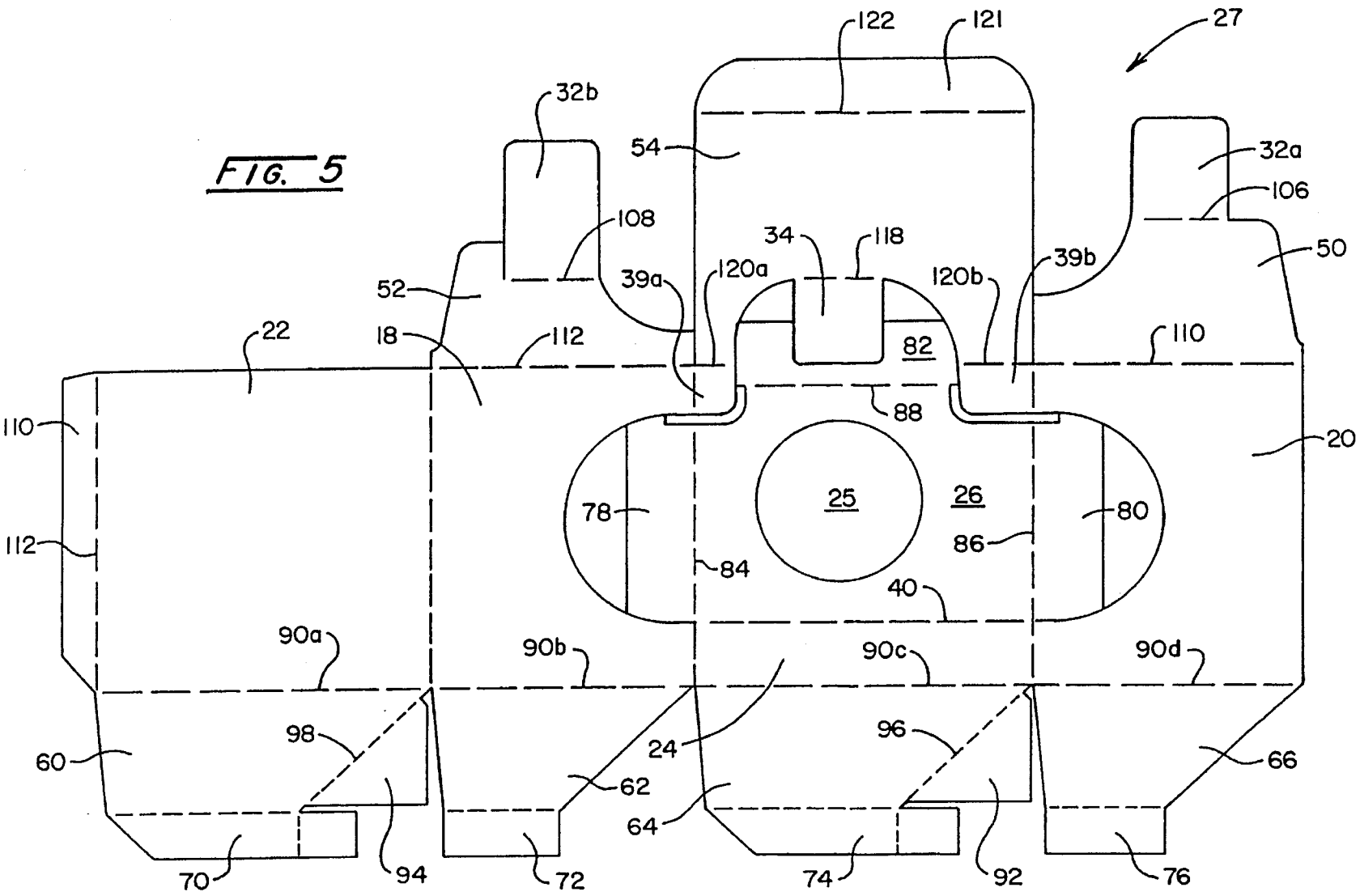
FIG. 5 is a plan view of a paperboard blank adapted in accordance with the present invention for assembly into the container of FIG. 1.

Looking now to FIGS. 3, 4, and 5, it may be appreciated that, by circularly configuring floating deck portion 26 opening 25, shown in FIG. 5, to receive base 17 of article 14, and by aligning tabs 32 and 34 axially with respect to opening 25, article 14 may be made to be axially rotatable therewithin opening 25 about retainer assembly 28. Advantageously, such rotation allows for the orienting of article 14 in a shipping position wherein handle 15 thereof is disposed generally orthogonal to fight side wall 20. In this regard, as is shown in FIG. 3, opening 25 may be eccentrically disposed within floating deck portion 26 to accommodate the outward extent of handle 15. As is shown in FIGS. 2 and 3, when article 14 is placed in its shipping position, the volumetric displacement of container assembly 10 is minimized and made generally cubic to facilitate an optimal close-packed arrangement of a plurality of containers 12 within a shipping carton or the like (not shown). For the improved visual inspection of article 14, it is preferred, as is shown in FIG. 1 at 36 and 37, to have sections removed or cut-outs from side walls 18 and 20. Side walls 18 and 20 may extend, however, to form, respectively, front extensions, 39*a* and 39*b*, about which lid 16 is downwardly folded to close container 12.

Referring next particularly to FIG. 4 and additionally to FIG. 1, article 14 is shown as rotated within opening 25, shown in FIG. 5, to a display position wherein handle 15 is disposed adjacent and generally orthogonal to front wall portion 26. In such position, the grasping and tactual inspection or demonstration of handle 15 by a potential purchaser is facilitated, a hand of whom is shown at 35. In this respect, opening 25 may be eccentrically disposed within floating deck portion 26 to extend handle 15 of article 14 beyond side walls 20 and 22, and front wall potion 24.

Looking again to FIGS. 4 and 5, wherein article 14 is shown with its handle 15 being grasped by a potential purchaser, the cooperation of retainer assembly 28 and floating deck portion 26 is revealed. With retaining tabs 32 and 34 being received into the annular extent of article 14 to retain the top of the article 14 laterally within container 12, floating deck portion 26 is freely, upwardly biased to be retained about annular wall 17 of article 14 even as article 14 is lifted upwards further into retainer assembly 28. In addition, as handle 15 of article 14 is pulled towards front wall portion 24 of container 12, the normal component of the force applied to floating deck portion 26 causes the further rotation thereof about its fold line, 40, with front wall portion 24. Such rotation maintaining the base of article 14 within opening 25, in connection with the extension of retainer assembly 28 into the annular extent of article 14, thereby prevents the removal of article 14 through the front of container 12 while allowing article 14 to be rotated freely therewithin for its shipping, display, or inspection.

To keep retainer assembly 28 within the annular extent of article 14 even as article 14 is forced downwards further into opening 25 (FIG. 5), a spacer assembly, shown generally at 38, is provided to extend upwardly from bottom 30 to floating deck portion 26. In addition to supporting the base 17 of article 14, spacer assembly 38 additionally functions to enhance the visual presentation of article 14 by elevating it a predetermined distance above bottom 30. Preferably, as is best seen in FIG. 1, article 14 may be removed from container 12 without the destruction thereof via the unfolding of lid 16 about its folds lines, 120*a* and 120*b*, to form an opening within container 12 of a size sufficient to permit the passing of article 14 therethrough.

Returning, to FIGS. 1 and 2, the operation of retainer assembly 28 is further detailed. Although alternate configurations are anticipated, e.g., a single front or side tab only, or a pair of side tabs only, front retaining tab 34 preferably operates in conjunction with side retaining tabs 32*a* and 32*b*, and vice versa, to retain the top of article 14 within container 12. Indeed, it will be appreciated in view of the discussion to immediately follow that the use of front retaining tab 34 in conjunction with side retaining tabs 32*a* and 32*b* is preferred as contact of the inner surface of article 14 annular wall 17 is with an edge of a retaining tab 32 or 34 irrespective of the direction of lateral movement of article 14. Such contact maximizes the structural strength of each of tabs 32 and 34, and of the overall structural strength of retaining assembly 28.

Particularly, front retaining tab 34 is provided to delimit the side-to-side lateral motion of the top of article 14. Absent this delimiting, either or both of side retaining tabs 32*a* and 32*b* could be rotated from a vertical to horizontal position with respect to lid 16, forcing them out of the annular extent of article 14 and into planar contact with lid 16. Alternatively or additionally, at least one of side tabs 32 may be sized as having a lengthwise extent greater than the inner annular diameter of article 14 to preclude its rotation thereout. Front retaining tab 34 also may be so sized to preclude its rotation out of the annular extent of article 14.

Similarly, side retaining tabs 32*a* and 32*b* are provided to delimit the front-to-back lateral motion of the top of article 14 to thereby prevent the rotation of front retaining tab from a vertical to horizontal position in planar contact with lid 16 and its being forced out of the annular extent of article 14. Again, alternatively or additionally, front tab 34 may be sized as having a widthwise extent greater than the perpendicular distance between side tabs 32*a* and 32*b*. When so sized, front tab 34 cannot be rearwardly rotated out of article 14 as such rotation is prevented by the contact of the reward surface of front tab 34 with the forward side edges of side tabs 32*a* and 32*b*.

Referring next to FIG. 5 in conjunction with FIGS. 1, 2, 3, and 4, a paperboard blank adapted for foldable assembly into container 12 is shown generally at 27, the surface of the blank forming the outer surface of container 12 being depicted. The surfaces of blank 27 forming rear wall 22, left side wall 18, and fight side wall 20 of container 12 are commonly referenced. A fight top flap, 50, from which fight side retaining tab 32*a* extends for folding about fold line 106, a left top flap, 52, from which left side retaining tab 32*b* extends for folding about fold line 108, and a front top flap, 54, from which front retaining tab 34 extends for folding about fold line 118, are provided for foldable assembly to form top wall or lid 16. Similarly, a rear bottom flap, 60, a left bottom flap, 62, a front bottom flap, 64, and a fight bottom flap, 66, are provided for foldable assembly about, respectively, fold lines 90*a*, 90*b*, 90*c*, and 90*d* to form bottom 30. For forming spacer assembly 38, shown in cross-section in FIG. 4, tabs 70, 72, 74 and 76 are provided to be upwardly foldable from, respectively, bottom flaps 60, 62, 64, and 66. Floating deck portion 26 may be seen to extend from front wall portion 24 for folding about fold line 40, and to be provided with peripheral tabs 78, 80, and 82, which are downwardly foldable about, respectively, fold lines 84, 86, and 88 to impart added rigidity to floating deck potion 26.

Figure 6:
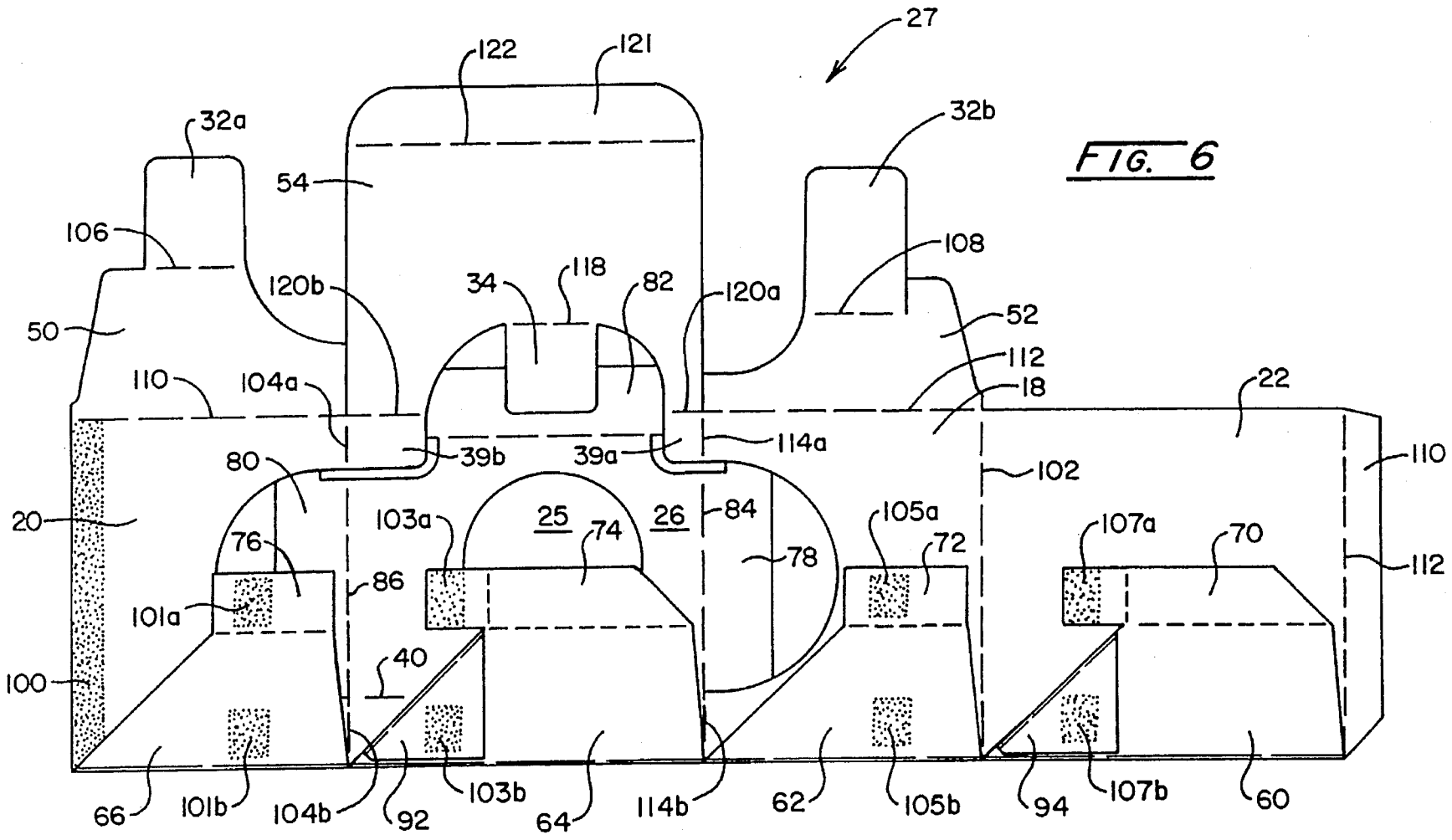
FIG. 6 is a plan view of the underside of the paperboard blank of FIG. 5 showing the bottom flaps thereof inwardly folded for the application of adhesive thereto.

Referring additionally to FIG. 6, the foldable assembly of blank 27 into container 12 next is described. In this regard, as is shown in FIG. 6, the orientation of blank 27 is reversed to upwardly dispose the surface of blank 27 forming the inner surface of container 12. Then, the assembly is commenced with the folding of bottom flaps 60, 62, 64 and 66 rearwardly along fold lines 90, and the folding of flaps 92 and 94 downwardly about, respectively, fold lines 96 and 98. At this point, as is represented by the shaded areas of FIG. 6, adhesive is applied to glue point 100, to either glue points 101*a* and 101*b* or 103*a* and 103*b*, and to either glue points 105*a* and 105*b* or 107*a* and 107*b*. Rear wall 22 then is folded along fold line 102 to join glue points 105*a* and 105*b* with, respectively, corresponding glue points 107*a* and 107*b*. Similarly, fight side wall 20 is folded along fold lines 104*a* and 104*b* to join glue points 101*a* and 101*b* with, respectively, corresponding glue points 103*a* and 103*b*, and to join glue point 100 with the backside of flap 110. At this stage, blank 27 is partially assembled, and is collapsed flat for storage or shipping.

Lastly, the final assembly of glued blank 27 into container 12 is described which advantageously may be completed at the manufacturing or packaging site of the article to be contained. As to the final assembly, the generally cubic structure of container 12 is attained by foldably expanding blank 27 about fold fines 102, 112, 114*a* and 114*b*, and 104*a* and 104*b*, each of said fold lines forming ah edge of the container. Thereafter, tabs 78, 80 and 82 are folded downwardly along, respectively, fold lines 84, 86 and 88, and folding deck portion 26 is folded into container 12 along fold line 40. Article 14 then may be introduced into container 12 through the opened top thereof for insertion of its base into opening 25 of floating deck portion 26. Right retaining tab 32*a* then is folded downwardly along fold line 106, with left retaining tab 32*b* folded downwardly along fold line 108. Next, right top flap 50 is folded orthogonally to right side wall 20 along fold line 110, and left top flap 52 is folded orthogonally to left side wall 18 along fold line 112 to thereby dispose retaining tabs 32 within the annular extent of article 14. Front top flap tab 121 and front retaining tab 34 then are folded orthogonally to front top flap 54 along, respectively, fold fine 122 and fold lines 120*a* and 120*b*. Lastly, container 12 is closed by folding top front flap 54 orthogonally to front side wall extensions 39*a* and 39*b* along fold lines 120 to thereby effect the insertion of front top flap tab 121 between rear wall 22 and top flaps 50 and 52, and the insertion of front retaining tab 34 into the annular extent article 14.

As is anticipated that certain changes may be made in the above-described invention without departing from the scope and precepts thereof which are herein involved, is intended that all matter contained in the foregoing description or shown in the accompanying figures shall be interpreted as illustrative rather than in a limiting sense.

What is claimed:

1. A container for accessibly displaying an article having an article base and a generally annular wall extending therefrom, said container comprising:

a top wall;

an oppositely disposed bottom wall;

a pair of oppositely disposed side walls extending between said top wall and said bottom wall;

a rear wall extending between said top wall and said bottom wall adjacent said side walls;

a retainer assembly extending downwardly from said top wall into said article for retaining the top of said article laterally within said container; and a base assembly having:

a floating deck portion disposed generally parallel to said bottom wall intermediate said top wall, said floating deck portion having an opening therethrough configured to receive said article base; and a front wall portion extending generally orthogonally from said floating deck portion to said bottom wall to locate said floating deck portion a predetermined distance above said bottom wall, said floating deck being inwardly folded about said front wall portion.

2. The container of claim 1 wherein said retainer assembly comprises at least one front retaining tab folded downwardly from said top wall generally parallel to said rear wall.

3. The container of claim 2 wherein said retainer assembly further comprises at least one side retaining tab folded downwardly from said top wall generally orthogonal to said front retaining tab.

4. The container of 3 wherein said retainer assembly comprises a pair of spaced-apart, oppositely disposed side retaining tabs.

5. The container of claim 4 wherein said front retaining tab has a widthwise extent about equal to the perpendicular distance between said side retaining tabs.

6. The container of claim 1 wherein said retainer assembly comprises at least one side retaining tab folded downwardly from said top wall generally orthogonal to said rear wall.

7. The container of claim 6 wherein said retainer assembly comprises a pair of spaced-apart oppositely disposed side retaining tabs.

8. The container of claim 1 wherein said floating deck portion opening is circular to receive a cylindrical article and is disposed in axial alignment with said retainer assembly for rotation of said article within said opening about said retainer assembly.

9. The container of claim 8 wherein said circular opening is eccentrically located within said floating deck portion for receiving a cylindrical article having a handle extending from its annular wall, said circular opening spacing said article a predetermined distance from a said side wall allowing said article to be rotated from a shipping position wherein said handle is disposed adjacent and generally orthogonal to said side wall to a display position wherein said handle is disposed adjacent and generally orthogonal to said floating deck front wall.

10. The container of claim 9 wherein said circular opening is eccentrically located within said floating deck portion to extend the handle of said article beyond said side walls and said floating decking front wall portion when said article is placed in said display position.

11. A packaged article comprising a container for accessibly displaying an article packaged therewithin, said article having an article base and a generally annular wall extending therefrom, said container comprising:

a top wall;

an oppositely disposed bottom wall;

a pair of oppositely disposed side walls extending between said top wall and said bottom wall;

a rear wall extending between said top wall and said bottom wall adjacent said side walls;

a retainer assembly extending downwardly from said top wall into said article for retaining the top of said article laterally within said container; and a base assembly having:

a floating deck portion disposed generally parallel to said bottom wall intermediate said top wall, said floating deck portion having an opening therethrough receiving said article base therewithin; and a front wall portion extending generally orthogonally from said floating deck portion to said bottom wall to locate said floating deck portion a predetermined distance above said bottom wall, said floating deck being inwardly folded about said front wall portion.

12. The packaged article of claim 11 wherein said retainer assembly of said container comprises at least one front retaining tab folded downwardly from said top wall generally parallel to said rear wall.

13. The packaged article of claim 12 wherein said retainer assembly further comprises at least one side retaining tab folded downwardly from said top wall generally orthogonal to said front retaining tab.

14. The packaged article of 13 wherein said retained assembly comprises a pair of spaced-apart, oppositely disposed side retaining tabs.

15. The packaged article of claim 14 wherein said front retaining tab has a widthwise extent about equal to the perpendicular distance between said side retaining tabs.

16. The packaged article of claim 11 wherein said retainer assembly of said container comprises at least one side retaining tab folded downwardly from said top wall generally orthogonal to said rear wall.

17. The packaged article of claim 16 wherein said retainer assembly comprises a pair of spaced-apart oppositely disposed side retaining tabs.

18. The packaged article of claim 11 wherein said article is cylindrical and said floating deck portion opening is circular and disposed in axial alignment with said retainer assembly for rotation of said article therewithin about said retainer assembly.

19. The package article of claim 18 wherein said article has a handle extending from its generally annular wall and said circular opening is eccentrically located within said floating deck portion to space said handle a predetermined distance from a said side wall allowing said article to be rotated from a shipping position wherein said handle is disposed adjacent and generally orthogonal to said side wall to a display position wherein said handle is disposed adjacent and generally orthogonal to said base assembly front wall portion.

20. The packaged article of claim 19 wherein said circular opening is eccentrically located within said floating deck portion to extend said handle of said article beyond said side walls and said base assembly front wall portion when said article is placed in said display position.

21. The packaged article of claim 19 wherein said circular opening is eccentrically located within said floating deck portion to space said article a predetermined distance from said front wall portion effective to dispose said article completely within said container when said article is placed in said shipping position.

22. The packaged article of claim 21 wherein said circular opening is eccentrically located to dispose said article a predetermined distance from said side walls and said rear wall.

23. The container of claim 1 wherein at least one of said top or side walls forms an openable lid.

24. The container of claim 1 wherein said deck portion is inwardly folded about said front wall portion to be generally upwardly biased for retaining said article base laterally within said floating deck portion opening.

25. The container of claim 11 wherein at least one of said top or side walls forms an openable lid.

26. The container of claim 11 wherein said deck portion is inwardly folded about said front wall portion to be generally upwardly biased for retaining said article base laterally within said floating deck portion opening.

* * * * *